United States Patent [19]

duPont

[11] Patent Number: 4,776,821

[45] Date of Patent: Oct. 11, 1988

[54] FORWARDS FACING HYDROFOIL OAR

[76] Inventor: Stephen duPont, 24 N. Casey Key, Osprey, Fla. 33559

[21] Appl. No.: 10,585

[22] Filed: Feb. 3, 1987

[51] Int. Cl.[4] ..... B63H 16/04

[52] U.S. Cl. ..... 440/101; 440/13

[58] Field of Search ..... 440/17, 101, 104, 102, 440/105, 103, 13–16, 21; 114/123; 416/74

[56] References Cited

U.S. PATENT DOCUMENTS 655,234 8/1900 Howe et al. ..... 114/123

FOREIGN PATENT DOCUMENTS 584543 3/1958 Italy ..... 440/102

OTHER PUBLICATIONS

"Calhoun Bow Facing Oars", Brochure–undated Calhoun Boat Works, Tiptonville, Tennessee.

"Forwards–Facing Oar Solves Boating Problem", Article (3/3/85), R. R. Rimmey, 103 Race St., Millheim, Penn.

*Primary Examiner*—Sherman D. Basinger
*Assistant Examiner*—Edwin L. Swinehart
*Attorney, Agent, or Firm*—John R. Doherty

[57] ABSTRACT

The present invention improves the efficiency of high performance rowing in shells. The oarsman faces forwards and uses "L" shaped oars with hydrofoil blades. The conventional handle loom section ends at the "L" at the outboard end of the usual outrigger. The "L" is supported by a special oarlock pivoted in the usual manner outboard by the outrigger. The blade loom section of the oar trails the oarlock and carries at its aft end a downwards projecting hydrofoil blade which is angled diverging forwards relative to the opposite blade. A teter pivot, horizontal in the oarlock, is angled to generally bisect the right angle of the "L" and supports of offset center of gravity of the "L" shaped oar. This pivot provides for raising and lowering the blade to the water by the handle in the conventional manner. The action of the hydrofoil blades in the water is to swing laterally outwards during the power stroke and to be raised from the water on the return stroke. Small pontoon floats having bottoms shaped for hydrodynamic planing, mounted to the outriggers below the oarlocks stabilize the narrow hull, since the span of the oars is too narrow and the hydrofoil blade cannot plane on the water, the oars cannot stabilize the boat as in conventional shells. The narrow span of the oars reduces the aerodynamic drag of headwinds, the forwards facing of the oarsman replacing the backwards facing of conventional shells simplifies guiding the boat, and the hydrofoil action is more efficient than paddle action of conventional oar blades. These advantages more than offset the hydrodynamic drag of the small planing pontoons.

5 Claims, 3 Drawing Sheets

FIG. 1
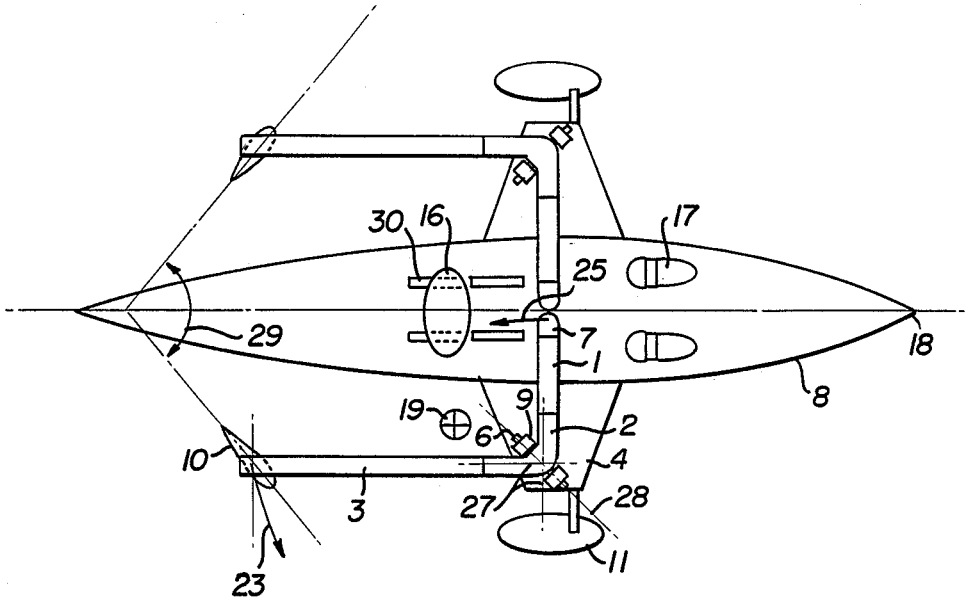
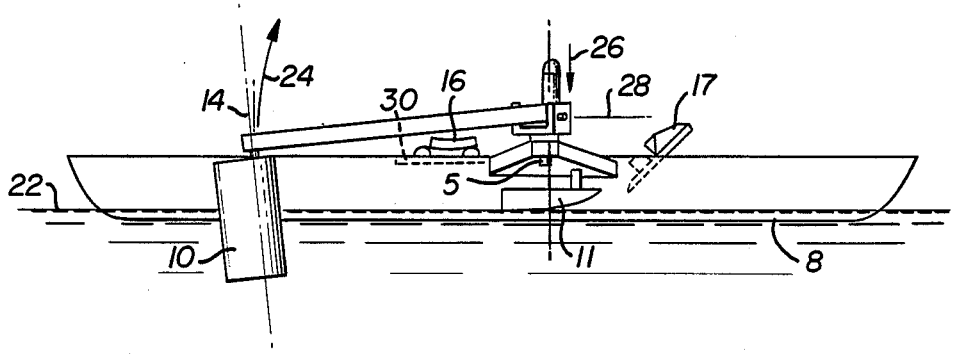
FIG. 2

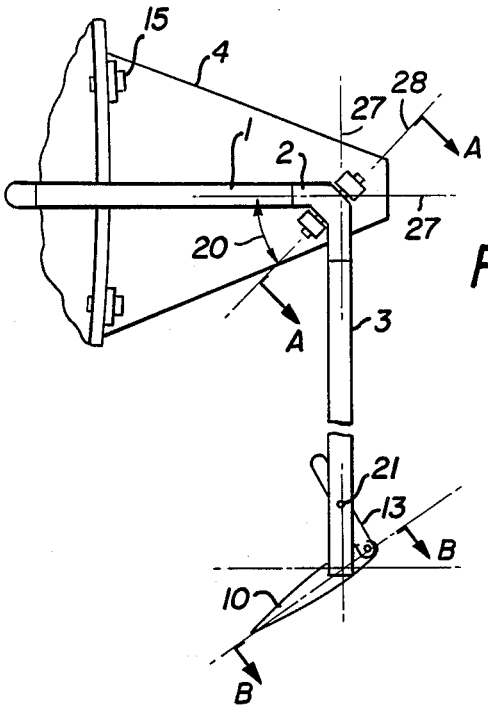
FIG. 3
FIG. 4
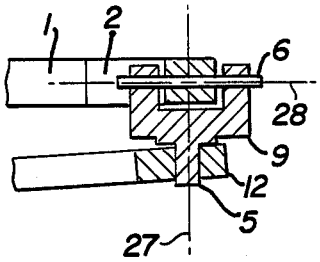
FIG. 5
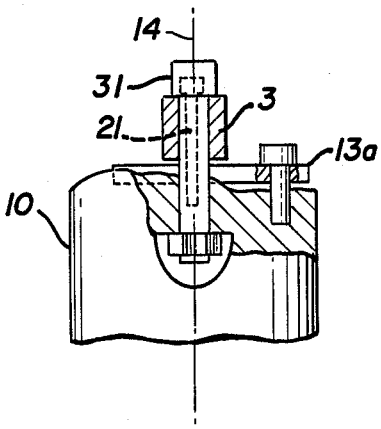
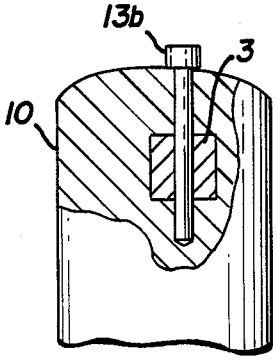
FIG. 6

FORWARDS FACING HYDROFOIL OAR

CROSS REFERENCE TO RELATED APPLICATIONS

The following patents are cited as References to the prior art for the present invention. None of them show functional or mechanical similarity to the present invention.

U.S. Pat. Nos. 530,519 Harbers, Bow Facing Oar. Dec. 11, 1894 823,075 Berron, Oar for Rowboat, 1906. 830,828 Petrich & Duloves, Bow Facing Oar. 830,828 Gagmon, Bow Facing Oar. September 1906. 1,207,584 Maher, Bow Facing Oar. December 1916. 2,167,636 Carlson, Oar Operating Mechanism. 2,536,441 L. F. Gustafson, Convertable Oar, Jan. 2, 1951. 3,729,369 Trull,; Bow Facing Oar. Apr. 24, 1973.

BACKGROUND OF THE PRESENT INVENTION

The present invention relates to improvements to high performance rowing apparatus.

Rowing for competition, recreation and excercise in specialized boats called shells has existed for over a century, and is a respected international and Olympic sport as well as being popular in schools and clubs and with individual sportsmen.

Shells are very narrow boats having long waterline lengths to attain what is known a high displacement-hull-speed and small surface area to reduce hydrodymamic friction drag. Outriggers extend laterally from the narrow hull to offer a wide support of the oarlocks for the purpose of reducing the angularity of the oars during the power stroke. The seats are mounted on rollers moving longitudinally to the boat on tracks, and the oarsmans's feet are secured to the boat against rigid footboards by means of shoelike restraints or straps. The oars, called sculls where each oarsman uses two, and sweeps where each oarsman uses only one, are long and light and incorporate curved blades. The oars are pivoted in hinged oarlocks carried in sockets at the extremities of the outriggers. Shells have to be balanced laterally due to their narrow hulls and the topheavy position of the oarsman over the narrow hull by the static floatation of and by dynamic planing of the oar blades in the water. The oarsman sits facing backwards for the purpoas of applying the most powerful muscles of the back, legs and arms from the foot stretchers to the oar handles during the power stroke in rowing. This backwards facing causes the oarsman to continually twist his neck and shoulders around to see forwards where he is going but most important to avoid running into obastacles including other boats. The twisting of the oarsman's neck and body restricts the free use of his important rowing muscles. The oar paddle blades produce thrust simply by pushing water backwards in the same direction of their backwards movement. It is well known that the paddle wheel steamer was less efficient than propeller driven steamers, because the paddle action is not as efficient a way of producing thrust as the angle of attack action of propeller blades. The lateral span of the sculls and sweeps is very large, exceeding nineteen feet with todays sculls and 24 feet with sweeps, which results in excessive aerodynamic drag when rowing against the wind.

The present invention offers improvements to high parformance rowing apparatus by causing the oarsman to face forwards instead of backwards, by improving the efficiency of producing thrust through the use of a hydrofoil function of the blades instead of by the paddle pushing action of conventional oars and thus reducing the wind resistance, by reducing the lateral span of the oars, and by eliminating the muscularly demanding task of balancing the boat by the oars, which improvement is accomplished by the use of the floatation and the hydrodynamic lifting of pontoons mounted below the extremities of the outriggers.

In the present invention, the improved efficiency of the forward facing seating and of the hydrofoil action of the blades, as well as the reduced wind resistance of the narrower span and reduced drag of planing the oars for balance on the return rowing stroke more than overcomes the drag of the added pontoons.

SUMMARY OF THE PRESENT INVENTION

The present invention incorporates an "L" shaped oarloom as viewed from above. One arm of the loom called a handle loom, is similar to the conventional handle portion of a conventional oar, lying athwartships at mid stroke and carrying a hand grip on the inboard and, while the "L" of the paddle loom is structured by elbow means to its outboard end. The other arm of the L is structured to the elbow means of the "L" at the arm's forward end, and lies fore and aft at mid stroke, trailing the elbow relative to the direction of travel of the boat. At the aft end of the blade loom section is mounted a hydrofoil blade projecting downwards, and lying in a generally vertical plane that is divergent forwards relative to the plane of the matching blade on the opposite side of the boat. An outrigger is structured to the hull extending outwards laterally. A sweephinge member such as a socket having a vertical axis is structured to the outer extremity of the outrigger. An oarlock member having a structured mating sweephinge means such as a pin is rotatably mounted to the outrigger hinge socket. The oarlock structures a horizontally axised so called teeter hinge member, lying in a vertical plane that is parallel and close to a vertical plane that generally bisects the right angle of the ebow of the oarloom. This teeter hinger mating member is structured to the oarloom near its elbow and supports the oarloom through the oarlock to the outrigger. Lowering the handle grip acts around the fulcrum of the teeter hinge, raising the blade loom and blade, and vice versa. The general parallelism of the horizontal teeter hinge axis to the bisector of the elbow, supports the displaced center of mass of the oarlock loom. This displacement of the mass center comes from the L shape of the oar assembly. The amount the center of gravity lies behind the bisector of the elbow determines how much weight of the paddle loom assembly the oarsman feels at his oar handles.

In the rowing power stroke, the handle is pulled aft by the forwards facing oarsman, which causes the blade to swing outwards about the oarlock sweep hinge. The divergent angles of the opposite blades cause the blades to move through the water with an an angle of attack of the hydrofoil resulting in "lift" as in an airfoil, or thrust as from the pitch angle of a propeller blade, the thrust being oriented generally normal to the direction of motion of the foil. This thrust is the source of the propulsion of the boat. Any angular component of the thrust vector relative to the boat's direction of motion due to the lateral skew of the force vector of this hydrodymnamic thrust in the right hand blade, is balanced and cancelled by the equal and opposite skew of the force vector action of the left hand blade. Of course pulling harder and faster with one oar will unballance the thrust and steer the boat as in conventional rowing.

Adjustment of the blade angle of incidence relative to the blade oarloom is possible by mounting the oar blade on a vertical axis hinge to the oarloom. Adjustment is possible statically, to be set and secured, or control by the oarsman can be done by suitable linkages bewteen the handle grip or from an accessory control lever accessable to the oarsman. For instance, a sprocket wheel mounted rigidly to the outrigger, and a sprocket wheel mounted to the top of the blade concentric with its vertical blade support pivot, both sprockets connected by chains or cables, would hold the angle of the blade by parallelogram geometry in relation to the fixed outrigger during the angular sweep of the oarloom. Varying the sprocket diameters in relation to one another will cause proportional changes relative to the sweep angle in the blade angle incidence during sweep. A further control can then be linked between a lever accessable to the oarsman and a moveable outrigger sprocket anchor to cause rotation of the sprocket relative to the outrigger, which allows the oarsman to control the angle of the blade at will regardless of the position of the rowing stroke, and at the same time feeds in some corrective angle to the blade that might be wanted.

During rowing as in conventional boats the oar can be teetered lifting the blade from the water on the return stroke by pushing down on the handle thus rotating the blade loom and handle loom assembly about the teeter hinge. An additional hinge not shown on drawings parallel to the blade chord line and generally horizontal near the blade top, can be used to mount the blade for feathering horizontally aftwards and upwards by trailing in the water should the oarsman fail to raise the blade from the water on the return stroke, but this option is not mandatory.

A further refinement option is to allow the blade to swivel angularly about its vertical axis against stops, the vertical axis being mounted in the blade hydrofoil ahead of the center of hydrodynamic pressure, and to leave the blade in the water during the return stroke, while it is producing some thrust.

DESCRIPTION OF DRAWINGS

FIG. 1 is a plan view of a boat and rowing apparatus according to the present invention;

FIG. 2 is an elevational view of the boat and rowing apparatus shown in FIG. 1;

FIG. 3 is an enlarged plan view of a part of the boat and rowing apparatus of FIG. 1, showing the mounting arrangement of oars with outrigger, teeter hinge bisecting elbow, handle loom with handle, and blade loom with blade;

FIG. 4 is a sectional view taken along the line A—A in FIG. 3, showing the oar lock with sweep hinge and teeter hinge;

FIG. 5 is a sectional view taken along the line B—B in FIG. 3, showing the blade loom with adjustable incidence;

FIG. 6 is the same as FIG. 5, showing the blade loom with fixed incidence.

NUMERICAL ITEMS IN DRAWINGS

Figure 7:
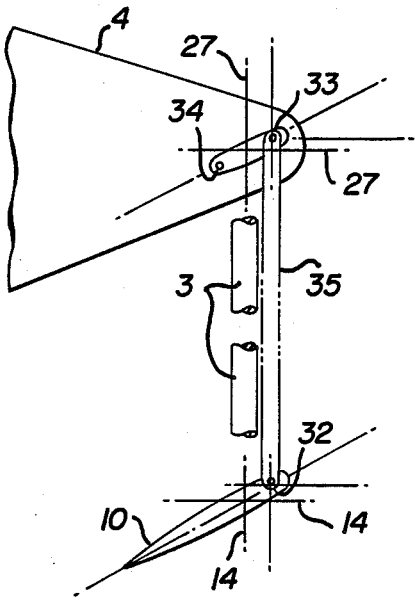
FIG. 7 is a view similar to FIG. 3, showing a modification for controlling the blade incidence.

1—Handle loom.
2—Elbow structure.
3—Blade loom.
4—Outrigger.
5—Sweep hinge pin.
6—Teter hinge pin,
7—Handle grip.
8—Boat hull.
9—Oarlock frame.
10—Hydrofoil blade,
11—Pontoon
12—Sweep hinge means, socket on outrigger.
13—Blade incidence angle restraint.
14—Blade incidence feathering axis.
15—Fasteners, outrigger to hull.
16—Seat.
17—Foot restraints, (stretchers).
18—Bow of boat.
19—Center of gravity of oar.
20—Elbow bisect angle.
21—Adjustment holes for blade incidence restraint.
22—Water line.
23—Blade sweep.
24—Blade teter.
25—Handle sweep.
26—Handle teter.
27—Sweep axis.
28—Teter axis.
29—Blade divergent forwards angle.
30—Seat track.
31—Adjustment restraint, blade incidence.
32—Blade lever arm measured end.
33—Outrigger lever arm measured end.
34—Outrigger lever restraint.
35—Link member.

DESCRIPTION OF THE PREFERRED EMBODIMENT

The general arrangement of a shell equipped with a rowing apparatus according to the the present invention is shown in FIG. 1 wherein the, numeral 8 is the hull of the shell, 4 is the outrigger bolted to the hull in the usual manner of shells as shown at 15 in FIG. 3 and, 1, is the handle loom with the hand grip 7. The hand grip 7 may be simply a properly sized and shaped protruberence to the loom fashioned from the loom material, or it may be a separate grip, and may be bearing mounted providing twist motion such as with motorcycle throttle control handlebar grips. As shown in FIG. 1 a blade loom 3 has a hydrofoil shaped blade 10 attached to it and projecting downwards. The attatchment of blade 10 to the aft end of blade loom 3 may be by rigid fixture to the blade loom or it may have a vertical axised rotation bearing mount to permit changeing the amgle of incidence of the hydrofoil blade relative to the loom centerline. This mount structure may provide by its design for the blade angle of incidence to be adjusted or it may provide for control of the blade angle through suitable linkages leading from the handle twist grip or a lever neither of which is shown for simpicity though the handle 7 in FIG. 3 does show a separate grip on the handle loom 1. Control from a twist grip handle is done in the common manner of twist grips on motorcycle handlebar and helicopter pitchsticks by levers and links, or by flexible cable in conduits or by sprockets and chains and so forth. as shown in FIGS. 1 and 2, a pontoon 11 is provided for balancing the narrow hull, and consists of narrow float having a bottom shaped for hydrodynamic lift and for planinging on the water. An loom elbow frame 2 is provided as shown in FIGS. 1 and 2 which can be made of suitable material such as metal or structural plastic and which is rigidly structured to the legs of the oarloom and forms its approximately right angle elbow. As shown more particularly in FIG. 4, 9 is the oarlock frame. And 6 is the oarlock hinge pin for the teter hinge that provides for pressing downwards or upwards on the handle to raise or lower, in that order, the blade in and out of the water. This hinge pin lies generally in the horizontal plane, and also in a vertical plane parallel to a vertical plane that generally bisects the right angle of the loom elbow 2. The purpose of the generally bisecting of the elbow is to provide support for the displaced center of gravity FIG. 1, 19 of the L shaped oar assembly. In FIG. 4, a pin 5 for the sweep hinge of the oarlock is provided and is structured to the oarlock frame and mounts it to swivel in the socket 12 of the outrigger. The sweep hinge pivots and permits pulling and pushing of the handle loom in the sweep action of rowing as shown by the arrow 25 in FIG. 1, which due to the elbow structure, 2 causes the blade loom to move laterally outwards, as depicted by the arrow 23, in the unique thrust stroke of the present invention. The outwards movement of the hydrofoil blade, taken with its divergent forwards angle 29 results in the angle of attack of the moving foil being presented to the water to produce, similar to the action of a prepeller blade, the thrust for propelling the boat. In FIG. 3 the restraint 13 is shown as one way of attatching the blade to the paddle loom which allows adjustment by shifting the angular position of the attachment fastening screws. In FIG. 5, the numeral 14 refers to is the generally vertical axis for incidence angle feathering of the blade during adjustment or control of its angle of incidence relative to the oarloom. In FIG. 7, the numeral 16 is the seat, 17 is the foot stretchers 18 is the bow of the boat, and 30 is the seat track.

FIGS. 3 and 5 show one way of mounting the blade where changes of incidence are desired. The blade mount incidence angle restraint 13 including adjustment holes 21 about axis 14 that permits adjustment of the incidence relative to the blade loom, and which if interconnected to a linkage from a hand grip or a lever on the handle loom, controls blade incidence about axis 14 at the oarsmans will. FIG. 6 shows a typical blade mount where the angle of blade incidence is fixed with reference to the blade loom.

FIG. 7 shows the blade incidence control linkage, wherein the numeral 32 is the measured end of the blade lever arm, 33 is the measured end of the outrigger lever arm and 35 is a link structure therebetween. A sprocket can substitute for a lever, and a pair of tension members such as chains or cables can substitute for a push pull link rod as has been described above.

The materials of construction are those normally used in the construction of boats, marine spars, oarlocks and the like, and include wood, aluminum, bronze, stainless steel, plastic including that reenforced by glass and carbon fibers, and the newer man made high tensile fibers. Methods of construction are those well known in the marine construction industry for many years.

What I claim is:

1. A rowing apparatus comprising, in combination: a boat having a hull with fore and aft ends and having an outrigger projecting laterally outwards from each side of said hull, at least two oars located one on each side of said hull, each of said oars comprising an L shaped oarloom including two legs joined at an elbow, one of said legs constituting a handle loom having a generally athwartship position at mid-stroke and the other of said legs constituting a blade loom trailing said elbow and lying generally fore and aft to the boat hull at mid-stroke, a sweep hinge member mounted onto each outrigger and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, and a blade having a hydrofoil shaped surface mounted to and below the aft end of each blade loom, said blade lying in a generally vertical plane which at mid-stroke is located at a forwardly divergent angle with respect to the plane of the blade mounted to the oarloom on the opposite side of said hull, the arrangement being such that said blade will move outwardly in a direction away from said hull when said handle loom is moved in a direction towards the aft end of said hull, the outwards movement of said blade taken with its forwardly divergent angle with respect to said other blade resulting in the hydrofoil surface of said blade moving through the water floating said hull in an angle of attack producing a thrust which is oriented generally normal to the direction of motion of said hydrofoil surface.

2. A rowing apparatus according to claim 1, further including hydro lift means mounted to each side of said hull or to each outrigger, said hydro lift means being positioned vertically near the water line and laterally spread outwardly from the center line of said hull.

3. A forward facing rowing apparatus comprising, in combination: a boat having a hull with fore and aft ends and having an outrigger projecting laterally outwards from each side of said hull, at least two oars located one on each side of said hull, each of said oars comprising an L shaped oarloom including two legs joined at an elbow, one of said legs constituting a handle loom having a generally athwartship position at mid-stroke and the other of said legs constituting a blade loom trailing said elbow and lying generally fore and aft to the boat hull at mid-stroke, seat means mounted on said hull and adapted to position the oarsman on the aft side of each handle loom while facing the fore end of said hull, a sweep hinge member mounted onto each outrigger and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, a blade having a hydrofoil shaped surface mounted to and below the aft end of each blade loom, said blade lying in a generally vertical plane which at mid-stroke is located at a forwardly divergent angle with respect to the plane of the other blade mounted to the oarloom on the opposite side of said hull, and means for changing the angle of incidence of said blade with respect to the direction of travel of said blade through the water floating said hull, the arrangement being such that said blade will move outwardly in a direction away from said hull when said handle loom is pulled towards said oarsman, the outwards movement of said blade taken with its forwardly divergent angle with respect to said other blade resulting in the hydrofoil surface of said blade moving through the water in an angle of attack producing a thrust which is oriented generally normal to the direction of motion of said hydrofoil surface.

4. A rowing apparatus comprising, in combination: a boat having a hull with fore and aft ends and having an outrigger projecting laterally outwards from each side of said hull, at least two oars located one on each side of said hull, each of said oars comprising an L shaped oarloom including two legs joined at an elbow, one of said legs constituting a handle loom having a generally athwartship position at mid-stroke and the other of said legs constituting a blade loom lying generally fore and aft to the boat hull at mid-stroke and having an outer free end, a sweep hinge member mounted onto each outrigger and adapted to rotate about a substantially vertical axis, said sweep hinge member including an oarlock frame adapted to mate with the L shaped oarloom of one of said oars at about said elbow, a teeter hinge member mounted to each oarlock frame and extending through the mating L shaped oarloom so as to permit rotation of said oarloom about a horizontal axis which is substantially coincident with a plane generally bisecting the right angle defined by said L shaped oarloom, and a blade having a hydrofoil shaped surface mounted to and below said outer free end of each blade loom, said blade lying in a generally vertical plane which at mid-stroke is located at an angle with respect to the plane of the blade mounted to the oarloom on the opposite side of said hull, the arrangement being such that said blade will move laterally to said hull when said handle loom is moved in a direction longitudinal to said hull, the lateral movement of said blade taken with its divergent angle with respect to said other blade resulting in the hydrofoil surface of said blade moving through the water floating said hull in an angle of attack producing a thrust which is oriented generally normal to the direction of motion of said hydrofoil surface.

5. A rowing apparatus according to claim 4, further including hydro lift means mounted to each side of said hull or to each outrigger, said hydro lift means being positioned vertically near the water line and laterally spread outwardly from the center line of said hull.

* * * * *